US008970120B2

(12) United States Patent
Liu et al.

(10) Patent No.: US 8,970,120 B2
(45) Date of Patent: Mar. 3, 2015

(54) LAMP DRIVING APPARATUS AND ILLUMINATION EQUIPMENT USING THE SAME

(71) Applicant: Beyond Innovation Technology Co., Ltd., Taipei (TW)

(72) Inventors: Zhen-Chun Liu, Taipei (TW); Chen-Lung Kao, Taipei (TW)

(73) Assignee: Beyond Innovation Technology Co., Ltd., Taipei (TW)

( * ) Notice: Subject to any disclaimer, the term of this patent is extended or adjusted under 35 U.S.C. 154(b) by 0 days.

(21) Appl. No.: 14/034,569

(22) Filed: Sep. 24, 2013

(65) Prior Publication Data

US 2014/0175998 A1 Jun. 26, 2014

(30) Foreign Application Priority Data

Dec. 22, 2012 (TW) ..... 101149285 A

(51) Int. Cl.
*H05B 37/02* (2006.01)

(52) U.S. Cl.
CPC ..... *H05B 37/02* (2013.01); *Y10S 315/05* (2013.01); *Y10S 315/07* (2013.01)
USPC ..... 315/209 R; 315/224; 315/291; 315/307; 315/DIG. 5; 315/DIG. 7

(58) Field of Classification Search
CPC ..... H05B 37/02; H05B 33/0815; H05B 41/2855; H05B 41/2828; H05B 41/2853; H05B 4/2925; H05B 41/292
USPC ..... 315/209 R, 224, 225, 291, 307, 362, 315/DIG. 5, DIG. 7
See application file for complete search history.

(56) References Cited

U.S. PATENT DOCUMENTS

| | | | | |
|---|---|---|---|---|
| 5,434,479 | A * | 7/1995 | Ohnishi et al. | 315/209 R |
| 7,372,214 | B2 * | 5/2008 | Song et al. | 315/291 |
| 2008/0136343 | A1 * | 6/2008 | Yu et al. | 315/219 |
| 2009/0295300 | A1 * | 12/2009 | King | 315/209 R |

FOREIGN PATENT DOCUMENTS

| | | |
|---|---|---|
| TW | M244703 | 9/2004 |
| TW | I299804 | 8/2008 |
| TW | I369502 | 8/2012 |

* cited by examiner

*Primary Examiner* — Douglas W Owens
*Assistant Examiner* — Thai Pham
(74) *Attorney, Agent, or Firm* — Winston Hsu; Scott Margo

(57) ABSTRACT

A lamp driving apparatus and an illumination equipment using the same are provided. The provided lamp driving apparatus is responsible for driving a lamp. When any one of two terminals of the lamp is opened or the lamp is over-voltage, the provided driving apparatus stops driving the lamp, and thus achieving the purpose of open lamp and over-voltage protection/detection.

16 Claims, 2 Drawing Sheets

LAMP DRIVING APPARATUS AND ILLUMINATION EQUIPMENT USING THE SAME

CROSS-REFERENCE TO RELATED APPLICATION

This application claims the priority benefit of Taiwan application serial no. 101149285, filed on Dec. 22, 2012. The entirety of the above-mentioned patent application is hereby incorporated by reference herein and made a part of this specification.

BACKGROUND OF THE INVENTION

1. Field of the Invention

The invention relates to an AC load driving technology, and more particularly to, a lamp driving apparatus and an illumination equipment using the same.

2. Description of Related Art

AC loads such as lamps in the market are generally lighted through a single high-voltage method, and such type of driving technology generally implements circuit protection measures such as open circuit protection and over-voltage protection according to a voltage signal in a lamp that is close to a ground potential (since it is easier to process with low-voltage signal), and said circuit protection measures are all required in actual applications. On the other hand, since the driving technology of a dual high-voltage method is novel, and two terminals of the lamp are all applied with high voltage signals, the conventional circuit protection measures designed for the driving technology which lights the lamp through the single high-voltage method is hard to be applied to the driving technology which lights the lamp through the dual high-voltage method. In this way, in order to innovate and break through the present known driving technology for the lamp, how to develop circuit protection measures suitable for the driving technology which lights the lamp through the dual high-voltage method is an urgent issue to be solved in the field.

SUMMARY OF THE INVENTION

Accordingly, a lamp driving apparatus according to an exemplary embodiment of the invention is provided, including: a power switching circuit, an LC resonator, a control chip and an open lamp and over-voltage detection circuit. Therein, the power switching circuit is coupled between a DC input high-voltage and a ground potential, and configured to switch and output the DC input high-voltage and the ground potential in response to two output signals with a phase difference of 180 degrees, so as to generate a square signal. The LC resonator is coupled to an output of the power switching circuit and configured to receive and convert the square signal, so as to generate a sinusoidal driving signal for driving a lamp.

The control chip is coupled to an input of the power switching circuit, and operated under a DC operating voltage. The control chip is configured to provide the two output signals with the phase difference of 180 degrees, so as to control operation of the power switching circuit. The open lamp and over-voltage detection circuit is coupled to control chip, and connected across two terminals of the lamp. The open lamp and over-voltage detection circuit is configured to: detect whether the lamp is opened or over-voltage; and send, when any one of the two terminals of the lamp is opened or the lamp is over-voltage, an abnormal signal indicating that any one of the two terminals of the lamp is opened or the lamp is over-voltage, to the control chip. In this case, the control chip may further stop providing the two output signals with the phase difference of 180 degrees in response to the abnormal signal.

In an exemplary embodiment of the invention, the open lamp and over-voltage detection circuit may be further configured to send, when the lamp is normal, a normal signal indicating that the lamp is normal, to the control chip, so as to make the control chip to normally provide the two output signals with the phase difference of 180 degrees, so as to control the operation of the power switching circuit.

In an exemplary embodiment of the invention, the open lamp and over-voltage detection circuit includes first to fourth capacitors, a first and a second diodes, a first and a second Zener diodes, an NPN-type bipolar junction transistor, and first to third capacitors. A first terminal of the first capacitor is coupled to a first terminal among the two terminals of the lamp. A first terminal of the second capacitor is coupled to a second terminal of the first capacitor, and a second terminal of the second capacitor is coupled to the ground potential. A cathode of the first diode is coupled to the second terminal of the first capacitor, and an anode of the first diode is coupled to the ground potential. A cathode of the first Zener diode is coupled to the second terminal of the first capacitor.

A first terminal of the third capacitor is coupled to a second terminal among the two terminals of the lamp. A first terminal of the fourth capacitor is coupled to a second terminal of the third capacitor, and a second terminal of the fourth capacitor is coupled to the ground potential. A cathode of the second diode is coupled to the second terminal of the third capacitor, and an anode of the second diode is coupled to the ground potential. A cathode of the second Zener diode is coupled to the second terminal of the third capacitor, and an anode of the second Zener diode is coupled to an anode of the first Zener diode.

A base of the NPN-type bipolar junction transistor is coupled to the anodes of the first and the second Zener diodes, and an emitter of the NPN-type bipolar junction transistor is configured to send the normal signal or the abnormal signal. A first terminal of the first resistor is coupled to the DC operating voltage, and a second terminal of the first resistor is coupled to a collector of the NPN-type bipolar junction transistor. A first terminal of the second resistor is coupled to the emitter of the NPN-type bipolar junction transistor, and a second terminal of the second resistor is coupled to the ground potential. The third resistor is connected across the base and the emitter of the NPN-type bipolar junction transistor.

In an exemplary embodiment of the invention, the open lamp and over-voltage detection circuit can further include a fourth and a fifth resistors. Therein, the fourth resistor is connected in parallel with the first Zener diode, and the fifth resistor is connected in parallel with the second Zener diode.

In an exemplary embodiment of the invention, the normal signal and the abnormal signal can both be voltage signals. In this case, when any one of the two terminals of the lamp is opened or the lamp is over-voltage, a level of the abnormal signal is greater than a reference level built in the control chip; otherwise, when the lamp is normal, a level of the normal signal is less than the reference level.

In an exemplary embodiment of the invention, the LC resonator includes a resonant capacitor and a boost isolated transformer. Therein, a first terminal the resonant capacitor is configured to receive the square signal. The boost isolated transformer has a primary side and a secondary side. A first terminal of the primary side of the boost isolated transformer is coupled to a second terminal of the resonant capacitor; a second terminal of the primary side is coupled to the ground potential; a first terminal of the secondary side of the boost isolated transformer is coupled to the first terminal of the lamp; and a second terminal of the secondary side of the boost isolated transformer is coupled to the second terminal of the lamp.

In an exemplary embodiment of the invention, the two output signals with the phase difference of 180 degrees include a first pulse-width modulation signal and a second pulse-width modulation signal. In this case, the power switching circuit includes an upper-arm N-type field-effect transistor and a lower-arm N-type field-effect transistor. Therein, a gate of the upper-arm N-type field-effect transistor is configured to receive the first pulse-width modulation signal, a drain of the upper-arm N-type field-effect transistor is configured to receive the DC input high-voltage, and a source of the upper-arm N-type field-effect transistor is configured to output the square signal. A gate of the lower-arm N-type field-effect transistor is configured to receive the second pulse-width modulation signal, a drain of the lower-arm N-type field-effect transistor is coupled to the source of the upper-arm N-type field-effect transistor, and a source of the lower-arm N-type field-effect transistor is coupled to the ground potential.

In an exemplary embodiment of the invention, the control chip may be further configured to adjust duty cycles of the first and the second pulse-width modulation signals in response to the square signal, thereby regulating the sinusoidal driving signal.

In an exemplary embodiment of the invention, the provided lamp driving apparatus may further include an AC-to-DC power conversion circuit which is coupled to the power switching circuit, and configured to receive an AC input power and convert the AC input power, so as to provide the DC input high-voltage. The AC-to-DC power conversion circuit may be implemented by using a combination of a bridge rectifier and a filter capacitor, but the invention is not limited thereto.

In an exemplary embodiment of the invention, the provided lamp driving apparatus may further include a DC voltage regulation circuit which is configured to receive the DC input high-voltage, and perform a voltage regulation process to the DC input high-voltage, so as to generate the DC operating voltage required for the control chip in operation. The DC voltage regulation circuit may be implemented by using a Zener diode/other voltage regulation device with a value identical to the DC operating voltage required for the control chip in operation, but the invention is not limited thereto.

An illumination equipment according to another exemplary embodiment of invention is provided, including a lamp, and the above-mentioned lamp driving apparatus responsible for driving the lamp.

In light of the foregoing, a lamp driving apparatus and an illumination equipment using the same are provided. The provided lamp driving apparatus is responsible for driving a lamp. When any one of two terminals of the lamp is opened or the lamp is over-voltage, the provided driving apparatus stops driving the lamp, and thus achieving the purpose of open lamp and over-voltage protection/detection. In other words, the provided lamp driving apparatus utilizes the driving technology which lights the lamp with the dual high-voltage method and is provided with functions of open lamp and over-voltage protection/detection.

However, the above descriptions and the below embodiments are only used for explanation, and they do not limit the scope of the invention.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
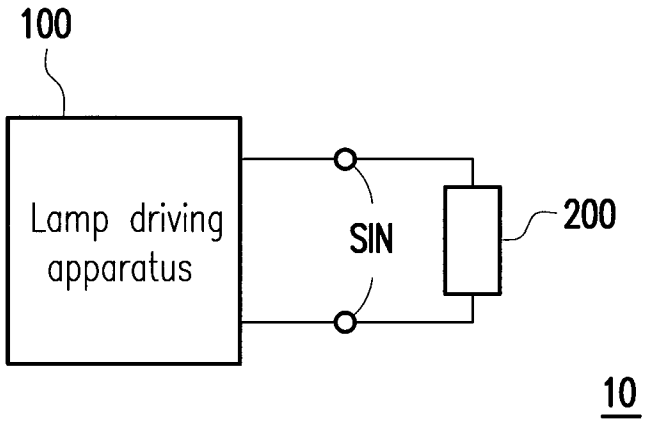
FIG. 1 is a schematic diagram illustrating an illumination equipment 10 according to an exemplary embodiment of the invention.

Descriptions of the invention are given with reference to the exemplary embodiments illustrated with accompanied drawings, wherein same or similar parts are denoted with same reference numerals. In addition, whenever possible, identical or similar reference numbers stand for identical or similar elements in the figures and the embodiments.

Figure 2:
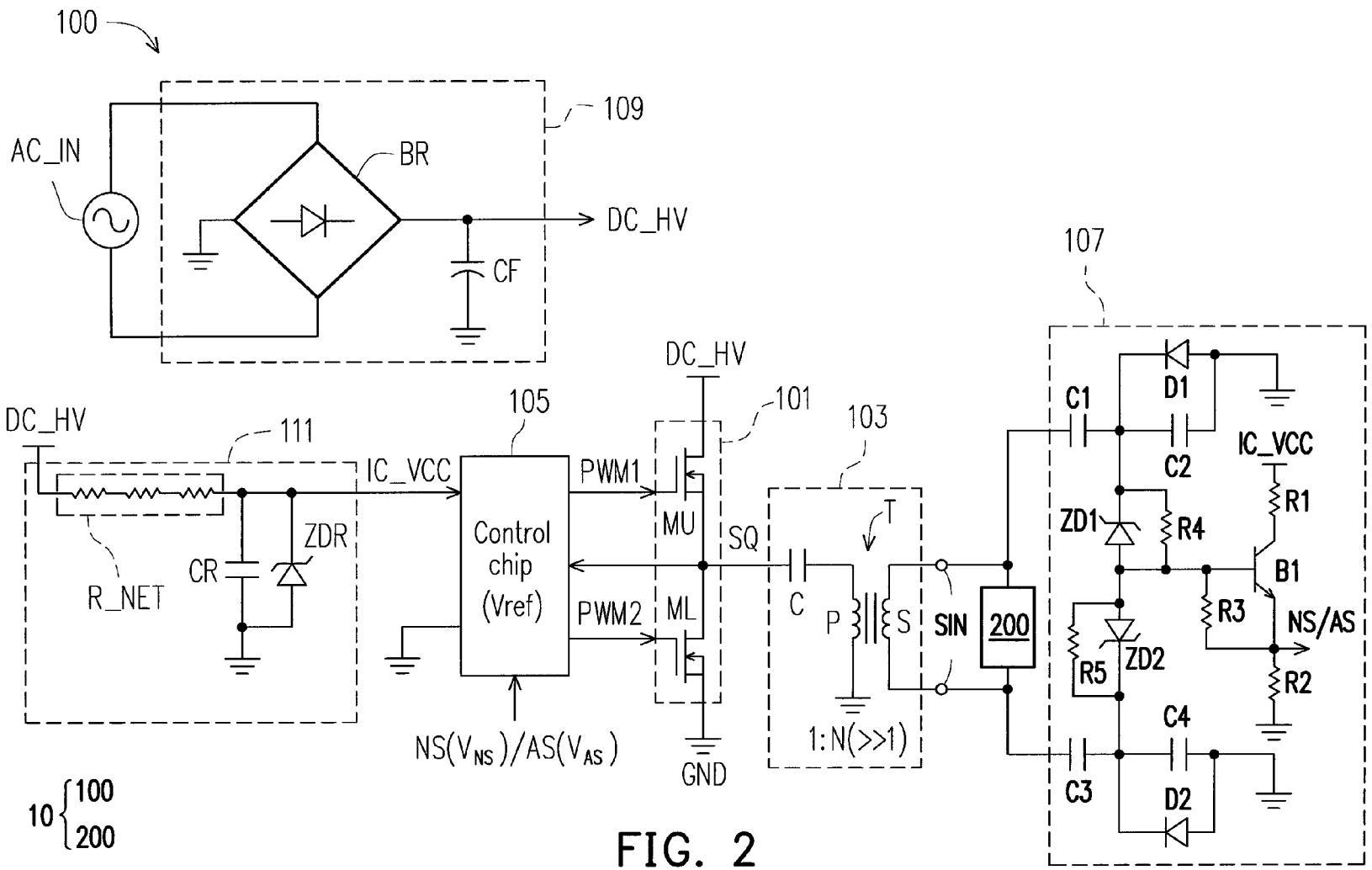
FIG. 2 is a schematic diagram illustrating an implementation of a lamp driving apparatus 100 responsible for driving a lamp 200 according to an exemplary embodiment of the invention.

FIG. 1 is a schematic diagram illustrating an illumination equipment 10 according to an exemplary embodiment of the invention, and FIG. 2 is a schematic diagram illustrating an implementation of a lamp driving apparatus 100 responsible for driving a lamp 200 according to an exemplary embodiment of the invention. Referring to FIG. 1 and FIG. 2 together, in the present exemplary embodiment, the lamp 200 can be a lamp of any types (e.g., a fluorescent lamp, a daylight lamp, a halogen lamp and so on, but the invention is not limited thereto, other lamps driven by adopting an AC method are also suitable), and the lamp 200 can emit light/generate a light source, in response to a sinusoidal driving signal SIN from the lamp driving apparatus 100.

The lamp driving apparatus 100 drives/lights the lamp 200 through a dual high-voltage method, and includes a power switching circuit 101, an LC resonator 103, a control chip 105, an open lamp and over-voltage detection circuit 107, an AC-to-DC power conversion circuit 109, and a DC voltage regulation circuit 111.

The AC-to-DC power conversion circuit 109 is coupled to the power switching circuit 101. The AC-to-DC power conversion circuit 109 is configured to receive an AC input power AC_IN (e.g., city power, but the invention is not limited thereto), and convert the received AC input power AC_IN (i.e., AC-to-DC power conversion), so as to provide a DC input high-voltage DC_HV.

More specifically, the AC-to-DC power conversion circuit 109 includes a bridge rectifier BR and a filter capacitor CF. The bridge rectifier BR is configured to receive the AC input power AC_IN, and perform a (full wave) rectification to the received AC input power AC_IN, so as to output the DC input high-voltage DC_HV. Further, the filter capacitor CF is coupled to an output of the bridge rectifier BR, and configured to filter the DC input high-voltage DC_HV, so as to stabilize the DC input high-voltage DC_HV. It should be noted that, although the AC-to-DC power conversion circuit 109 of the present exemplary embodiment is implemented by using a full-bridge rectification architecture, the AC-to-DC power conversion circuit 109 may also be implemented by using a half-bridge rectification architecture, depending on practical design/application requirements.

The DC voltage regulation circuit 111 is configured to receive the DC input high-voltage DC_HV from the AC-to-DC power conversion circuit 109, and perform a voltage regulation process to the DC input high-voltage DC_HV, so as to generate a DC operating voltage IC_VCC (e.g., 10 to 15V, but the invention is not limited thereto) required for the control chip 105 in operation.

More specifically, the DC voltage regulation circuit 111 includes a series resistor network R_NET, a regulation capacitor CR and a regulation Zener diode ZDR. A first terminal of the series resistor network R_NET is configured to receive the DC input high-voltage DC_HV, and a second terminal of the series resistor network R_NET is configured to output the DC operating voltage IC_VCC to the control chip 105. The regulation capacitor CR is coupled between the second terminal of the series resistor network R_NET and a ground potential GND. A cathode of the regulation Zener diode ZDR is coupled to the second terminal of the series resistor network R_NET, and an anode of the regulation Zener diode ZDR is coupled to the ground potential GND. It should be noted that, although the DC voltage regulation circuit 111 of the present exemplary embodiment is implemented by using the regulation Zener diode ZDR, the DC voltage regulation circuit 111 may also be implemented by using other voltage regulation device(s) other than the regulation Zener diode ZDR, depending on practical design/application requirements.

The power switching circuit 101 is coupled between the DC input high-voltage DC_HV and the ground potential GND. The power switching circuit 101 is configured to switch and output the DC input high-voltage DC_HV and the ground potential GND in response to two output signals with a phase difference of 180 degrees (e.g., two pulse-width modulation signals PWM1 and PWM2 with a phase difference of 180 degrees), so as to generate a square signal SQ.

More specifically, the power switching circuit 101 includes an upper-arm N-type field-effect transistor MU and a lower-arm N-type field-effect transistor ML. A gate of the upper-arm N-type field-effect transistor MU is configured to receive the pulse-width modulation signal PWM1, a drain of the upper-arm N-type field-effect transistor MU is configured to receive the DC input high-voltage DC_HV, and a source of the upper-arm N-type field-effect transistor MU is configured to output the square signal SQ. A gate of the lower-arm N-type field-effect transistor ML is configured to receive the pulse-width modulation signal PWM2, a drain of the lower-arm N-type field-effect transistor ML is coupled to the source of the upper-arm N-type field-effect transistor MU, and a source of the lower-arm N-type field-effect transistor ML is coupled to the ground potential GND. It should be noted that, although the power switching circuit 101 of the present exemplary embodiment is implemented by using a half-bridge switching architecture, the power switching circuit 101 may also be implemented by using a full-bridge switching architecture, depending on practical design/application requirements.

The LC resonator 103 is coupled to an output of the power switching circuit 101. The LC resonator 103 is configured to receive and convert the square signal SQ from the power switching circuit 101, so as to generate the sinusoidal driving signal SIN for driving the lamp 200. More specifically, the LC resonator 103 includes a resonant capacitor C and a boost isolated transformer T. A first terminal the resonant capacitor C is configured to receive the square signal SQ. The boost isolated transformer T has a primary side P and a secondary side S. A first terminal of the primary side P of the boost isolated transformer T is coupled to a second terminal of the resonant capacitor C; a second terminal of the primary side P is coupled to the ground potential GND; a first terminal of the secondary side S of the boost isolated transformer T is coupled to a first terminal of the lamp 200; and a second terminal of the secondary side S of the boost isolated transformer T is coupled to a second terminal of the lamp 200.

The control chip 105 is served as a control core of the lamp driving apparatus 100. The control chip 105 is coupled to an input of the power switching circuit 101, and operated under the DC operating voltage IC_VCC generated by the DC voltage regulation circuit 111. The control chip 105 is configured to provide the two pulse-width modulation signals (PWM1 and PWM2) with the phase difference of 180 degrees, so as to control operation of the power switching circuit 101. Moreover, the control chip 105 may be further configured to adjust duty cycles of the pulse-width modulation signals (PWM1 and PWM2), thereby regulating the sinusoidal driving signal SIN generated by the LC resonator 103.

The open lamp and over-voltage detection circuit 107 is coupled to control chip 105, and connected across two terminals of the lamp 200. The open lamp and over-voltage detection circuit 107 is configured to: detect whether the lamp 200 is opened or over-voltage; and send, when any one of two terminals of the lamp 200 is opened or the lamp 200 is over-voltage, an abnormal signal AS indicating that any one of the two terminals of the lamp 200 is opened or the lamp 200 is over-voltage, to the control chip 105. Accordingly, the control chip 105 stops providing the two pulse-width modulation signals (PWM1 and PWM2) with the phase difference of 180 degrees in response to the abnormal signal AS. In other words, when any one of the two terminals of the lamp 200 is over-voltage or the lamp 200 is over-voltage, the lamp driving apparatus 100 stops driving the lamp 200. Obviously, the lamp driving apparatus 100 is provided with an open lamp and over-voltage protection/detection function/measure.

Otherwise, the open lamp and over-voltage detection circuit 107 may be further configured to send, when the lamp 200 is normal, a normal signal NS indicating that the lamp 200 is normal, to the control chip 105, so as to make the control chip 105 to normally provide the two pulse-width modulation signals (PWM1 and PWM2) with the phase difference of 180 degrees, so as to control the operation of the power switching circuit 101. In other words, when the lamp 200 is normal, the lamp driving apparatus 100 can normally drive the lamp 200.

In the present exemplary embodiment, the open lamp and over-voltage detection circuit 107 includes capacitors C1 to C4, diodes D1 to D2, Zener diodes ZD1 to ZD2, an NPN-type bipolar junction transistor (BJT) B1 and resistors R1 to R5. A first terminal of the capacitor C1 is coupled to a first terminal among the two terminals of the lamp 200. A first terminal of the capacitor C2 is coupled to a second terminal of the capacitor C1, and a second terminal of the capacitor C2 is coupled to the ground potential GND. A cathode of the diode D1 is coupled to the second terminal of the capacitor C1, and an anode of the diode D1 is coupled to the ground potential GND.

A first terminal of the capacitor C3 is coupled to a second terminal among the two terminals of the lamp 200. A first terminal of the capacitor C4 is coupled to a second terminal of the capacitor C3, and a second terminal of the capacitor C4 is coupled to the ground potential GND. A cathode of the diode D2 is coupled to the second terminal of the capacitor C3, and an anode of the diode D2 is coupled to the ground potential GND. A cathode of the Zener diode ZD1 is coupled to the second terminal of the capacitor C1; a cathode of the Zener diode ZD2 is coupled to the second terminal of the capacitor C3; and an anode of the Zener diode ZD2 is coupled to an anode of the Zener diode ZD1. The resistor R4 is connected in parallel with the Zener diode ZD1, and the resistor R5 is connected in parallel with the Zener diode ZD2. It should be noted that, the resistors R4 and R5 are optional.

A base of the NPN-type bipolar junction transistor B1 is coupled to the anodes of the Zener diodes (ZD1 and ZD2), and an emitter of the NPN-type bipolar junction transistor B1 is configured to send the normal signal NS or the abnormal signal AS to the control chip 105. A first terminal of the resistor R1 is coupled to the DC operating voltage IC_VCC, and a second terminal of the resistor R1 is coupled to a collector of the NPN-type bipolar junction transistor B1. A first terminal of the resistor R2 is coupled to the emitter of the NPN-type bipolar junction transistor B1, and a second terminal of the resistor R2 is coupled to the ground potential GND. The resistor R3 is connected across the base and the emitter of the NPN-type bipolar junction transistor B1.

In the present exemplary embodiment, the normal signal NS and the abnormal signal AS may both be voltage signals ($V_{NS}$, $V_{AS}$). In this case, when any one of the two terminals of the lamp 200 is opened or the lamp 200 is over-voltage, a level of the abnormal signal AS ($V_{AS}$, for instance, when the NPN-type bipolar junction transistor B1 is ON and operated in a saturation region, $V_{AS}$=(IC_VCC*R2)/(R1+R2)>5V, but the invention is not limited thereto) is greater than a reference level Vref (e.g., 4V, but the invention is not limited thereto) built in the control chip 105; otherwise, when the lamp 200 is normal, a level of the normal signal NS ($V_{NS}$, for instance, when the NPN-type bipolar junction transistor B1 is OFF, $V_{NS}$<4V, but the invention is not limited thereto) is less than the reference level Vref (=4V).

Based on above, when the first terminal of the lamp 200 is opened, a potential at the second terminal of the lamp 200 is significantly increased, so that the NPN-type bipolar junction transistor B1 is ON and operated in the saturation region. In this case, the open lamp and over-voltage detection circuit 107 is activated to send the abnormal signal AS ($V_{AS}$>5V) associated/related to the lamp 200 being opened, to the control chip 105. Once the control chip 105 has determined that the level of the abnormal signal AS ($V_{AS}$>5V) is greater than the reference level Vref (=4V) being built in, the control chip 105 stops providing the two pulse-width modulation signals (PWM1 and PWM2) with the phase difference of 180 degrees, so as to make the lamp driving apparatus 100 to stop driving the lamp 200, thereby achieving the purpose of open lamp protection.

Similarly, when the second terminal of the lamp 200 is opened, a potential at the first terminal of the lamp 200 is significantly increased, so that the NPN-type bipolar junction transistor B1 is ON and operated in the saturation region. In this case, the open lamp and over-voltage detection circuit 107 is activated to send the abnormal signal AS ($V_{AS}$>5V) associated/related to the lamp 200 being opened, to the control chip 105. Once the control chip 105 has determined that the level of the abnormal signal AS ($V_{AS}$>5V) is greater than the reference level Vref (=4V) being built in, the control chip 105 stops providing the two pulse-width modulation signals (PWM1 and PWM2) with the phase difference of 180 degrees, so as to make the lamp driving apparatus 100 to stop driving the lamp 200, thereby achieving the purpose of open lamp protection.

On the other hand, when the lamp 200 is over-voltage, for instance, when a peak-to-peak value of the sinusoidal driving signal SIN is greater than a predetermined tolerance value, the Zener diodes ZD1 and ZD2 are in breakdown, so that the NPN-type bipolar junction transistor B1 is ON and operated in the saturation region. In this case, the open lamp and over-voltage detection circuit 107 is activated to send the abnormal signal AS ($V_{AS}$>5V) associated/related to the lamp 200 being over-voltage, to the control chip 105. Once the control chip 105 has determined that the level of the abnormal signal AS ($V_{AS}$>5V) is greater than the reference level Vref (=4V) being built in, the control chip 105 stops providing the two pulse-width modulation signals (PWM1 and PWM2) with the phase difference of 180 degrees, so as to make the lamp driving apparatus 100 to stop driving the lamp 200, thereby achieving the purpose of over-voltage protection.

Of course, when the lamp 200 is normal, the NPN-type bipolar junction transistor B1 is OFF. In this case, the open lamp and over-voltage detection circuit 107 is inactivated to send the normal signal NS ($V_{NS}$<4V) associated/related to the lamp 200 being normal, to the control chip 105. Once the control chip 105 has determined that the level of the abnormal signal NS ($V_{NS}$<4V) is less than the reference level Vref (=4V) being built in, the control chip 105 normally provides the two pulse-width modulation signals (PWM1 and PWM2) with the phase difference of 180 degrees to control the operation of the power switching circuit 101, so as to make the lamp driving apparatus 100 to normally drive the lamp 200.

Obviously, it can be known from disclosures/teachings of foregoing exemplary embodiments that, the lamp driving apparatus 100 utilizes a driving technology/architecture that lights the lamp 200 through the dual high-voltage method, and based on the open lamp and over-voltage detection circuit 107, the lamp driving apparatus 100 is provided with the open lamp and over-voltage protection/detection function/measure. It should be noted that, although the foregoing exemplary embodiments is illustrated using a circuit implementation of the open lamp and over-voltage detection circuit 107 as an example, but the invention is not limited thereto. In other words, as long as said functions of the open lamp and over-voltage detection circuit 107 remains unchanged, the circuit implementation of the open lamp and over-voltage detection circuit 107 can be appropriately altered or redesigned.

In summary, a lamp driving apparatus and an illumination equipment using the same are provided. The provided lamp driving apparatus is responsible for driving a lamp. When any one of two terminals of the lamp is opened or the lamp is over-voltage, the provided driving apparatus stops driving the lamp, and thus achieving the purpose of open lamp and over-voltage protection/detection. In other words, the provided lamp driving apparatus utilizes the driving technology which lights the lamp with the dual high-voltage method and is provided with functions of open lamp and over-voltage protection/detection.

On the other hand, the provided lamp driving apparatus can at least realize/achieve the following advantages.

1. Applicability in lamps with different powers.
2. Easy to setup and adjust a protection point when replacing different lamps.
3. Regardless of lamps with large or small powers, over-voltage or open circuit protection voltage can all be adjusted to fall within a safe usage range.

It will be apparent to those skilled in the art that various modifications and variations can be made to the structure of the disclosed embodiments without departing from the scope or spirit of the disclosure. In view of the foregoing, it is intended that the disclosure cover modifications and variations of this specification provided they fall within the scope of the following claims and their equivalents.

Any of the embodiments or any of the claims of the invention does not need to achieve all of the advantages or features disclosed by the present invention. Moreover, the abstract and the headings are merely used to aid in searches of patent files and are not intended to limit the scope of the claims of the present invention.

What is claimed is:

1. A lamp driving apparatus, comprising:

a power switching circuit coupled between a DC input high-voltage and a ground potential, and configured to switch and output the DC input high-voltage and the ground potential in response to two output signals with a phase difference of 180 degrees, so as to generate a square signal;

an LC resonator coupled to an output of the power switching circuit and configured to receive and convert the square signal, so as to generate a sinusoidal driving signal for driving a lamp;

a control chip coupled to an input of the power switching circuit and operated under a DC operating voltage, and the control chip being configured to provide the output signals to control operation of the power switching circuit; and an open lamp and over-voltage detection circuit coupled to the control chip and connected across two terminals of the lamp, and the open lamp and over-voltage detection circuit being configured to: detect whether the lamp is opened or over-voltage; and send, when any one of the two terminals of the lamp is opened or the lamp is over-voltage, an abnormal signal indicating that any one of the two terminals of the lamp is opened or the lamp is over-voltage, to the control chip, wherein the control chip further stops providing the output signals in response to the abnormal signal, wherein the open lamp and over-voltage detection circuit is further configured to send, when the lamp is normal, a non signal indicating that the lamp is normal, to the control chip, so as to make the control chip to normally provide the output signals to control the operation of the power switching circuit, wherein the open lamp and over-voltage detection circuit comprises:

a first capacitor having a first terminal coupled to a first terminal among the two terminals of the lamp;

a second capacitor having a first terminal coupled to a second terminal of the first capacitor, and a second terminal coupled to the ground potential;

a first diode having a cathode coupled to the second terminal of the first capacitor, and an anode coupled to the ground potential;

a first Zener diode having a cathode coupled to the second terminal of the first capacitor;

a third capacitor having a first terminal coupled to a second terminal among the two terminals of the lamp;

a fourth capacitor having a first terminal coupled to a second terminal of the third capacitor, and a second terminal coupled to the ground potential;

a second diode having a cathode coupled to the second terminal of the third capacitor, and an anode coupled to the ground potential;

a second Zener diode having a cathode coupled to the second terminal of the third capacitor, and an anode coupled to an anode of the first Zener diode;

an NPN-type bipolar junction transistor having a base coupled to the anodes of the first and the second Zener diodes, and an emitter configured to send the normal signal or the abnormal signal;

a first resistor having a first terminal coupled to the DC operating voltage, and a second terminal coupled to a collector of the NPN-type bipolar junction transistor;

a second resistor having a first terminal coupled to the emitter of the NPN-type bipolar junction transistor, and a second terminal coupled to the ground potential; and a third resistor connected across the base and the emitter of the NPN-type bipolar junction transistor.

2. The lamp driving apparatus of claim 1, wherein the open lamp and over-voltage detection circuit further comprises:

a fourth resistor connected in parallel with the first Zener diode; and a fifth resistor connected in parallel with the second Zener diode.

3. The lamp driving apparatus of claim 1, wherein:

the normal signal and the abnormal signal are both voltage signals;

a level of the abnormal signal is greater than a reference level built in the control chip when any one of the two terminals of the lamp is opened or the lamp is over-voltage; and a level of the normal signal is less than the reference level when the lamp is no ial.

4. The lamp driving apparatus of claim 1, wherein the LC resonator comprises:

a resonant capacitor having a first terminal configured to receive the square signal; and a boost isolated transformer having a primary side and a secondary side, wherein a first terminal of the primary side is coupled to a second terminal of the resonant capacitor, a second terminal of the primary side is coupled to the ground potential, a first terminal of the secondary side is coupled to the first terminal of the lamp, and a second terminal of the secondary side is coupled to the second terminal of the lamp.

5. The lamp driving apparatus of claim 1, wherein the output signals comprise a first pulse-width modulation signal and a second pulse-width modulation signal, and the power switching circuit comprises:

an upper-arm N-type field-effect transistor having a gate configured to receive the first pulse-width modulation signal, a drain configured to receive the DC input high-voltage, and a source configured to output the square signal; and a lower-arm N-type field-effect transistor having a gate configured to receive the second pulse-width modulation signal, a drain coupled to the source of the upper-arm N-type field-effect transistor, and a source coupled to the ground potential.

6. The lamp driving apparatus of claim 5, wherein the control chip is further configured to adjust duty cycles of the first and the second pulse-width modulation signals in response to the square signal, thereby regulating the sinusoidal driving signal.

7. The lamp driving apparatus of claim 1, further comprising:

an AC-to-DC power conversion circuit coupled to the power switching circuit, and configured to receive an AC input power and convert the AC input power, so as to provide the DC input high-voltage.

8. The lamp driving apparatus of claim 7, wherein the AC-to-DC power conversion circuit comprises:

a bridge rectifier configured to receive the AC input power and rectify the AC input power, so as to output the DC input high-voltage; and a filter capacitor coupled to an output of the bridge rectifier, and configured to filter the DC input high-voltage.

9. The lamp driving apparatus of claim 1, further comprising:

a DC voltage regulation circuit configured to receive the DC input high-voltage, and perform a voltage regulation process to the DC input high-voltage, so as to generate the DC operating voltage required for the control chip in operation.

10. The lamp driving apparatus of claim 9, wherein the DC voltage regulation circuit comprises:

a series resistor network having a first terminal configured to receive the DC input high-voltage, and a second terminal configured to output the DC operating voltage to the control chip;

a regulation capacitor coupled between the second terminal of the series resistor network and the ground potential; and a regulation Zener diode having a cathode coupled to the second terminal of the series resistor network, and an anode coupled to the ground potential.

11. An illumination equipment, comprising:

a lamp configured to emit light in response to a sinusoidal driving signal; and a lamp driving apparatus, comprising:

a power switching circuit coupled between a DC input high-voltage and a ground potential, and configured to switch and output the DC input high-voltage and the ground potential in response to two output signals with a phase difference of 180 degrees, so as to generate a square signal;

an LC resonator coupled to an output of the power switching circuit and configured to receive and convert the square signal, so as to generate the sinusoidal driving signal for driving the lamp;

a control chip coupled to an input of the power switching circuit and operated under a DC operating voltage, and the control chip being configured to provide the output signals to control operation of the power switching circuit; and an open lamp and over-voltage detection circuit coupled to the control chip and connected across two terminals of the lamp, and the open lamp and over-voltage detection circuit being configured to: detect whether the lamp is opened or over-voltage; and send, when any one of the two terminals of the lamp is opened or the lamp is over-voltage, an abnormal signal indicating that any one of the two terminals of the lamp is opened or the lamp is over-voltage, to the control chip, wherein the control chip further stops providing the output signals in response to the abnormal signal, wherein the open lamp and over-voltage detection circuit is further configured to send, when the lamp is normal, a normal signal indicating that the lamp is normal, to the control chip, so as to make the control chip to normally provide the output signals to control the operation of the power switching circuit, wherein the open lamp and over-voltage detection circuit comprises:

a first capacitor having a first terminal coupled to a first terminal among the two terminals of the lamp;

a second capacitor having a first terminal coupled to a second terminal of the first capacitor, and a second terminal coupled to the ground potential;

a first diode having a cathode coupled to the second terminal of the first capacitor, and an anode coupled to the ground potential;

a first Zener diode having a cathode coupled to the second terminal of the first capacitor;

a third capacitor having a first terminal coupled to a second terminal among the two terminals of the lamp;

a fourth capacitor having a first terminal coupled to a second terminal of the third capacitor, and a second terminal coupled to the ground potential;

a second diode having a cathode coupled to the second terminal of the third capacitor, and an anode coupled to the ground potential;

a second Zener diode having a cathode coupled to the second terminal of the third capacitor, and an anode coupled to an anode of the first Zener diode;

an NPN-type bipolar junction transistor having a base coupled to the anodes of the first and the second Zener diodes, and an emitter configured to send the normal signal or the abnormal signal;

a first resistor having a first terminal coupled to the DC operating voltage, and a second terminal coupled to a collector of the NPN-type bipolar junction transistor;

a second resistor having a first terminal coupled to the emitter of the NPN-type bipolar junction transistor, and a second terminal coupled to the ground potential; and a third resistor connected across the base and the emitter of the NPN-type bipolar junction transistor.

12. The illumination equipment of claim 11, wherein the open lamp and over-voltage detection circuit further comprises:

a fourth resistor connected in parallel with the first Zener diode; and a fifth resistor connected in parallel with the second Zener diode.

13. The illumination equipment of claim 11, wherein:

the normal signal and the abnormal signal are both voltage signals;

a level of the abnormal signal is greater than a reference level built in the control chip when any one of the two terminals of the lamp is opened or the lamp is over-voltage; and a level of the normal signal is less than the reference level when the lamp is normal.

14. The illumination equipment of claim 11, wherein the LC resonator comprises:

a resonant capacitor having a first terminal configured to receive the square signal; and a boost isolated transformer having a primary side and a secondary side, wherein a first terminal of the primary side is coupled to a second terminal of the resonant capacitor, a second terminal of the primary side is coupled to the ground potential, a first terminal of the secondary side is coupled to the first terminal of the lamp, and a second terminal of the secondary side is coupled to the second terminal of the lamp.

15. The illumination equipment of claim 11, wherein the output signals comprise a first pulse-width modulation signal and a second pulse-width modulation signal, and the power switching circuit comprises:

an upper-arm N-type field-effect transistor having a gate configured to receive the first pulse-width modulation signal, a drain configured to receive the DC input high-voltage, and a source configured to output the square signal; and a lower-arm N-type field-effect transistor having a gate configured to receive the second pulse-width modulation signal, a drain coupled to the source of the upper-arm N-type field-effect transistor, and a source coupled to the ground potential, wherein the control chip is further configured to adjust duty cycles of the first and the second pulse-width modulation signals in response to the square signal, thereby regulating the sinusoidal driving signal.

16. The illumination equipment of claim 11, wherein the lamp driving apparatus further comprises:

an AC-to-DC power conversion circuit coupled to the power switching circuit, and configured to receive an AC input power and convert the AC input power, so as to provide the DC input high-voltage; and a DC voltage regulation circuit configured to receive the DC input high-voltage, and perform a voltage regulation process to the DC input high-voltage, so as to generate the DC operating voltage required for the control chip in operation.

* * * * *